US005136864A

United States Patent [19]

Spiekermann et al.

[11] Patent Number: 5,136,864

[45] Date of Patent: Aug. 11, 1992

[54] LOCK FOR A SLIDE FASTENER OF A SUITCASE OR SIMILAR RECEPTACLE

[75] Inventors: Michael Spiekermann, Menden, Fed. Rep. of Germany; Richard J. Rekuc, Pattenburg, N.J.

[73] Assignee: Firma Sudhaus Schloss- und Beschlagtechnik GmbH & Co., Iserlohn, Fed. Rep. of Germany

[21] Appl. No.: 667,304

[22] Filed: Mar. 8, 1991

[51] Int. Cl.[5] ..... E05B 67/38

[52] U.S. Cl. ..... 70/68; 70/312

[58] Field of Search ..... 70/68, 312, 69–76, 70/67

[56] References Cited

U.S. PATENT DOCUMENTS

| | | | |
|---|---|---|---|
| 3,270,535 | 9/1966 | Fukuroi | 70/68 |
| 3,319,743 | 5/1967 | Pelavin et al. | 70/68 X |
| 3,597,945 | 7/1969 | Feinberg | 70/68 |
| 4,366,684 | 1/1983 | Bako et al. | 70/68 |
| 4,756,173 | 7/1988 | Yang | 70/68 |
| 4,790,156 | 12/1988 | Yang | 70/68 |
| 4,856,306 | 8/1989 | Scelba et al. | 70/68 |
| 4,930,323 | 6/1990 | Terada et al. | 70/68 |

*Primary Examiner*—Renee S. Luebke
*Assistant Examiner*—Suzanne L. Dino
*Attorney, Agent, or Firm*—Herbert Dubno

[57] ABSTRACT

A lock for a slide fastener of an article of luggage has a post onto which the gripper flap of the slider of the slide fastener is placed so that the post passes through a hole in the flap. A manually shiftable keeper member on the lock housing has an edge which engages over the gripper flap and is biased against the post by a first spring. A second spring surrounding the post can eject the gripper flap when the keeper member is manually retracted against the force of the first spring. The edge of the keeper member adjacent the post is beveled to facilitate pressing of the gripper flap between the post and the keeper member.

20 Claims, 4 Drawing Sheets

LOCK FOR A SLIDE FASTENER OF A SUITCASE OR SIMILAR RECEPTACLE

FIELD OF THE INVENTION

Our present invention relates to a lock for a slide fastener of a receptacle, e.g. a suitcase, trunk, attache case or any other receptacle which can have an opening between two parts or between a lid and a body closed by a slide fastener.

BACKGROUND OF THE INVENTION

In U.S. Pat. No. 4,366,684, a lock for a slide fastener has been disclosed which includes a post engageable by the gripping flap of the slide fastener slider which has a hole adapted to fit over the post. The gripping flap is blocked on the post by a swingable closure cap which can be pivotal between a blocking position in which the post is covered by the cap and a position in which the flap is swung out from the body of the lock and the post to permit removal of the flap in the open position of the lock. In the closed position of the case a combination-lock mechanism may be effective to prevent opening. In i&s blocking position, the closure cap prevents the gripping flap from being drawn off the post. The suitcase or other receptacle is thereby held closed.

To close this lock, the closure cap must be initially unlocked and then swung into its projecting open position exposing the post. The gripping flap must then be shoved over the post so that the post traverses the opening in this flap. The closure cap is then returned to its blocking position. In closing the latch formed by the closure cap, the user must be careful that the gripping flap has not pulled off the post or stud since effective blocking is then not possible. Upon opening of the lock, after release of the combination lock mechanism, the closure flap or latch must be swung into its open position enabling the gripping flap to be drawn off the post or stud manually. This lock system has been found to be expensive and difficult to handle in certain ways. Esthetically, when the latch is open, the lock leaves much to be desired.

OBJECTS OF THE INVENTION

It is, therefore, an important object of the invention to provide a lock for a slide fastener of luggage or the like which can be actuated in a simple manner and which has no portions which are exposed in an open state of the lock which can be readily damaged or which can create a potential of injury to the user.

Another object of this invention is to provide a simple and easily manipulated locking having an improved appearance and a more compact design than earlier locks operating with slide fasteners.

Still another object of this invention is to provide an improved lock for a slide fastener of a suitcase or other receptacle whereby drawbacks of the previously described prior art lock are avoided.

SUMMARY OF THE INVENTION

These objects and others which will become apparent hereinafter are attained in a lock for a receptacle having a slide fastener with a slider with a gripping flap provided with a hole, the lock comprising:

a housing;

a post projecting from the housing and positioned to project through the flap upon placing of the flap over the post;

a keeper member displaceable on the housing in a direction generally transverse to the post for engaging over the flap in a retention position to retain the flap on the post and for releasing the flap for withdrawal from the post upon displacement into a release position, the keeper member being formed with an inclined surface at a portion of the keeper member proximal to the post for camming by the flap away from the post to permit fitting of the flap over the post; and a spring braced between the housing and the keeper member for biasing the keeper member yieldably into the retention position and resisting camming by the flap away from the post, the keeper member being shaped to enable manual shifting of the keeper member against a force of the spring away from the post to release the flap.

According to the invention, therefore, instead of using a swingable flap or latch member in the form of a cap which covers the stud or post, the keeper member of the latch or lock of the invention is a member which can be drawn away from the post or stud by the finger of the user against a spring force, namely, the force of a first spring which biases the keeper member into its blocking position. The inclined surface or bevel of the end of the keeper member turned toward the stud or post provides a camming function since the pressing of the gripping flap of the slide fastener over the post or stud will displace the keeper member against the force of the spring to permit it to clear the gripping flap and reengage thereover.

With the lock of the invention, a manual actuation of the latch member in a closing direction is eliminated since the keeper member is moved automatically in the closing direction by its spring. Furthermore any gripping flap already mounted on the stud or post will be retained thereon while a second gripping flap is applied without concern for inadvertent release because the keeper member is withdrawn only by the application of applying the second gripper flap and is not retained in an open position during the fitting of the gripper flaps over the post.

Because the keeper member is movable only in its plane in accordance with the system of the invention, the lock is devoid of all components which may project from the lock or from the luggage wall and might detrimentally effect the appearance of the lock or cause injury or suffer damage. According to a feature of the invention, another or second spring at the post bears against the gripper flap to urge the gripper flap of the post to avoid movement of the keeper member into its release position.

This second spring serves to automatically eject the gripper flap or both gripper flaps, when the lock is disposed between two slide fastener sliders, when the user draws the keeper member into its release position against the force of the first spring.

It has been found to be advantageous to mount the second spring on the post or stud and to provide at the free end of the spring, i.e. the spring end turned away from the housing, a split washer which can bear against the flap or flaps. It has been found to be advantageous to form this washer or ring with a circumferentially extending recess which facilitates snapping the washer over or onto the post or stud. This ejection spring advantageously can be under precompression and a well defined spring action can be obtained when the stroke of this precompressed spring is limited by an abutment edge formed at the free end of the post or stud. The precompression can then be so selected that reliable ejection of the gripper flaps is insured when the keeper member is drawn away from the stud or post.

It has been found to be advantageous for forcing the gripper flaps over the stud or post, to provide the free end of the post with a bevel or incline converging toward the housing with the incline or bevel on the keeper member.

Structural simplification and reliable functioning of the first spring is insured when the latter is formed as a spring shack on the keeper member at an end thereof opposite the end turned toward the stud or post and is engaged with the housing of the lock. To lock the keeper member in its retention or locking position, the lock of the invention can be provided with a key operated mechanism or a combination lock mechanism, the latter having a plurality of number wheels.

It has been found to be advantageous, moreover, to form the housing with recesses shaped to accommodate the gripping flaps of the slide fastener, thereby reducing any tendency of the flaps to rotate about the post or stud.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
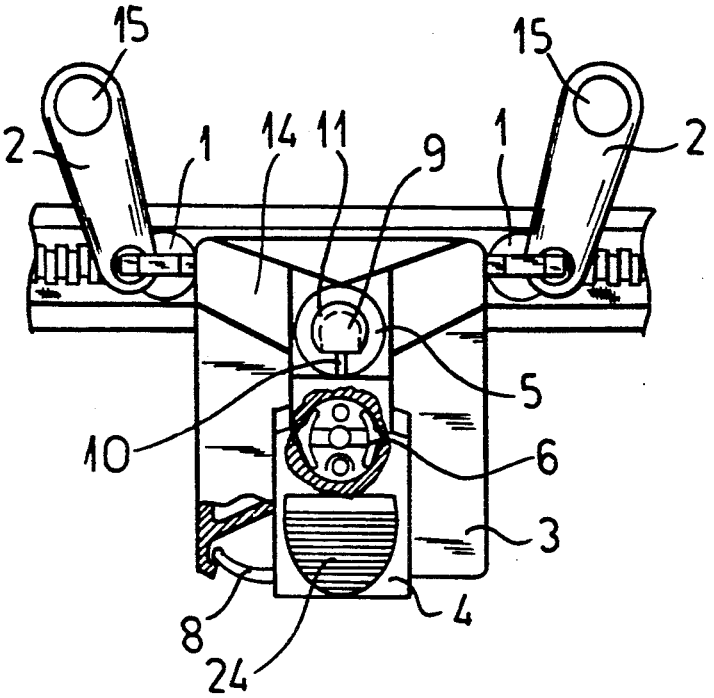
FIG. 1 is an elevational view of a lock assembly according to the invention with the gripping flaps of the slide fastener released an broken away.
Figure 1A:
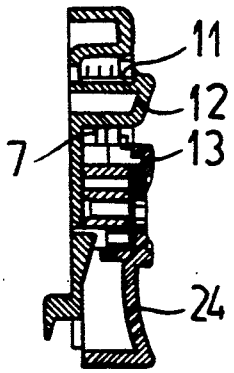
FIG. 1A is a cross sectional view through this lock.
Figure 2:
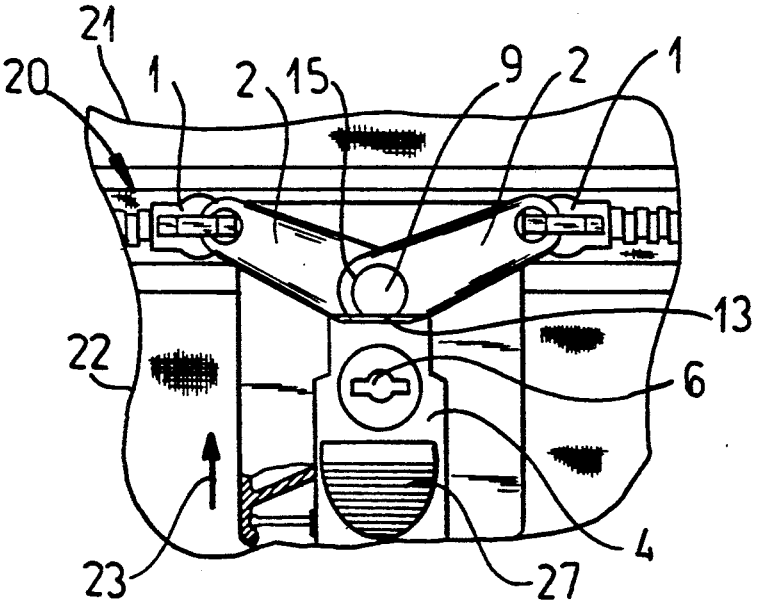
FIG. 2 is a view similar to FIG. 1 showing the lock thereof engaging the gripper flaps of the slide fastener.
Figure 2A:
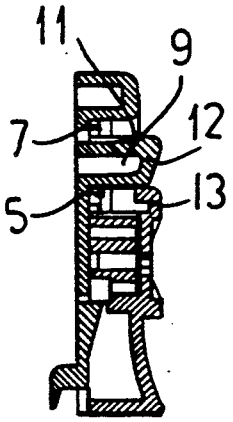
FIG. 2A is a cross sectional view through the lock in its gripping although the flaps are not seen thereon.
Figure 2B:
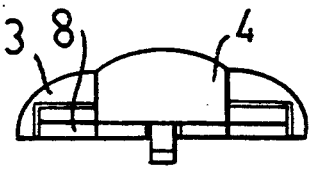
Figure 3:
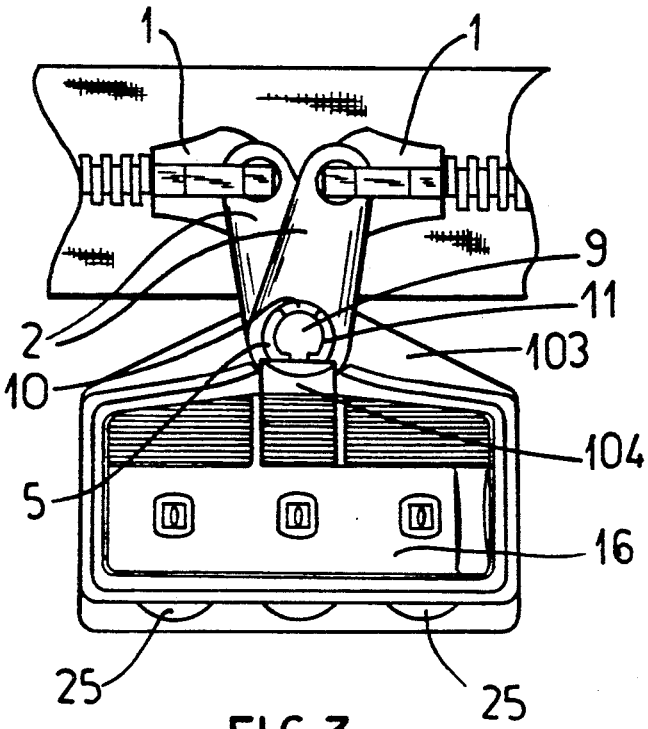
FIG. 3 is an elevational view of a lock according to another embodiment of the invention in engagement with the gripper flaps of its slide fastener and having a combination-lock mechanism.
Figure 3A:
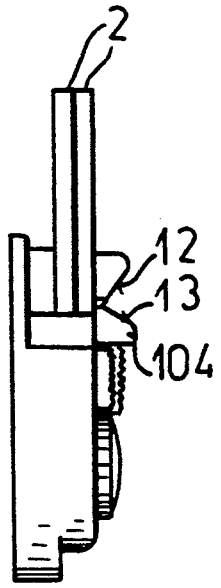
FIG. 3A is a side elevational view of the lock of FIG. 3.
Figure 4:
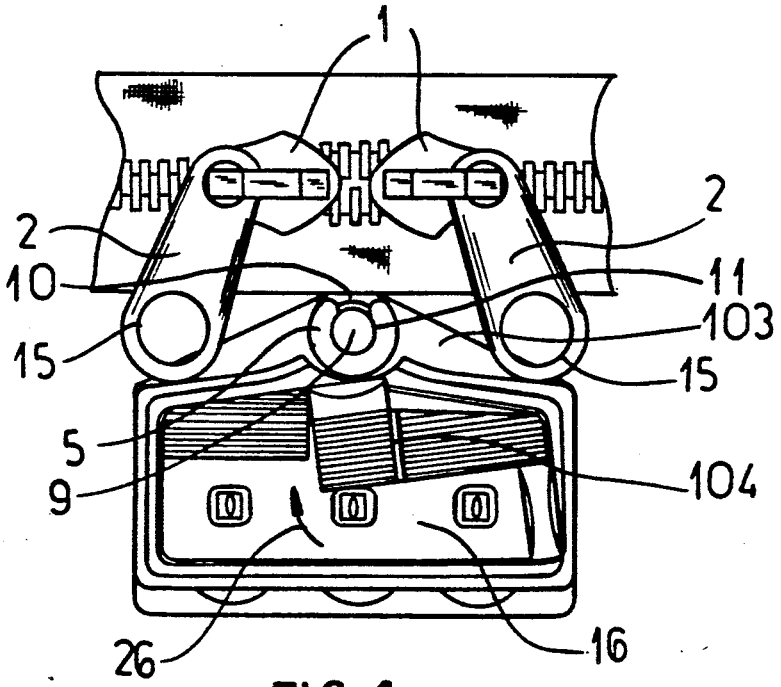
FIG. 4 is a view similar to FIG. 3 of the structure thereon in an open position of the lock.
Figure 5:
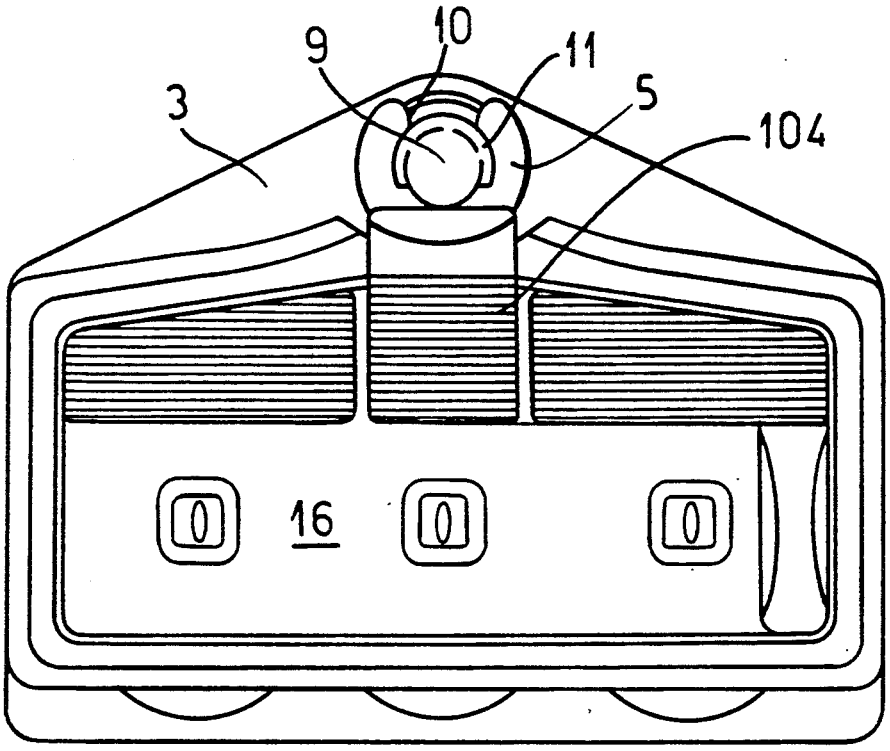
FIG. 5 is a view of the embodiment of FIG. 4 drawn to a larger scale and shown in its closed position.
Figure 5B:
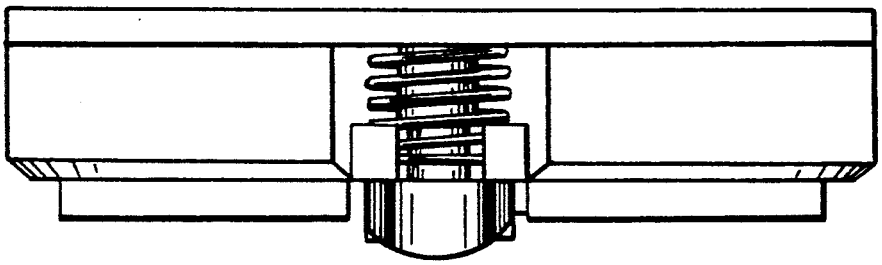
FIG. 5B is a top view thereof.
Figure 5A:
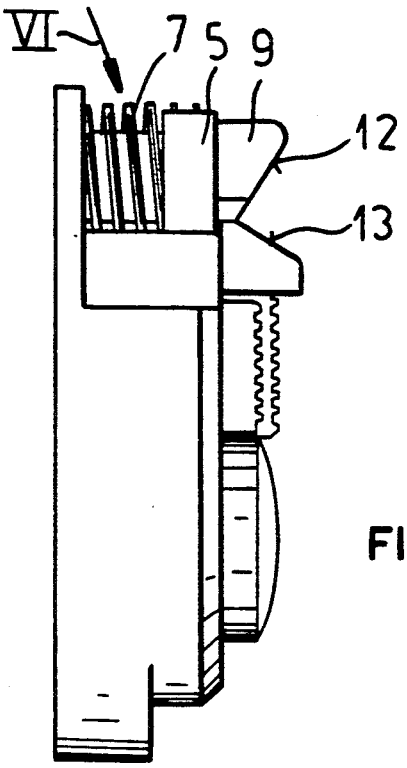
FIG. 5A is a side elevational view of the lock of FIG. 5.

The lock shown in FIGS. 1-2B serves to engage the gripper flaps 2 of a double slide fastener 20 whose sliders are represented at 1 and which close an opening between two parts 21 and 22 of an article of luggage such as a suitcase, attache case or the like.

The lock comprises a housing 3 having an upright projecting stud or post 9 thereon with an outer diameter smaller than the diameters of holes 15 formed in the free ends of the gripper flaps 2. The openings 15 are circular and the stud or post 9 is generally cylindrical. As a consequence, it is possible to fit the gripper flaps 2 over the stud or post 9.

Figure 6:
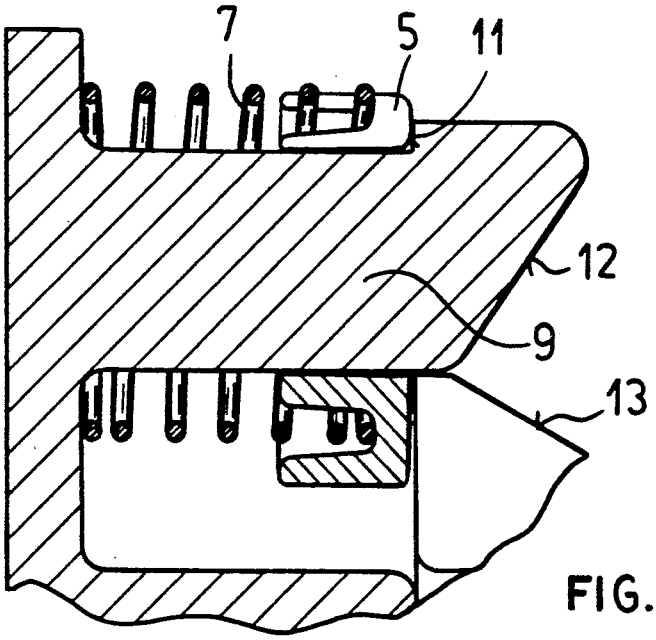
FIG. 6 is a detailed view of the region VI of FIG. 5A.

A lifting or ejection spring 7, in the form of a coil spring of the compression type forming the second spring of the invention, surrounds the post 9 and is seated at its lower end against the housing 3. At its upper end, the spring 7 is formed with a split washer 5, the construction of which may be that shown in FIG. 6. To limit the axial displacement of the washer 5 and to maintain the spring 7 under compression, in the region of the free end of the post 9, an abutment edge 11 is provided against which the upper surface of the washer 5 engages. The abutment 11 establishes the maximum stroke of the second spring means formed by the spring 7 and the washer 5 in the direction of the free end of the post 9. To facilitate the application of the washer 5 to the post 9, the washer 5 is formed with a circumferential extending cutout 10 enabling the washer 5, because of the elasticity of the material from which it is made, to be pressed over the post 9 past the abutment edge 11.

The housing 3 is formed with a pair of recesses 14 conforming in shape to that of the gripper flaps 2 and in which the gripper flaps or flags 2 are receivable when the post 9 extends through the openings 15.

The lock further comprises a keeper member 4 slidable on the housing 3 in the vertical direction (FIGS. 1, 1A, 2, 2A) and shiftable between a blocking position in which an end of the keeper member lies against the post 9 at the free end thereof so that gripper flaps 2 on the post 9 are blocked against removal, and a release position in which the end of the keeper member 4 clears the gripper flags 2 to enable them to be dislodged from the post 9 by the action of the spring 7.

Close to its end remote from the post 9, the keeper member 4 is formed with a spring shank 8 which engages at its free end the housing 3 so that the resulting first spring acts in the direction of the arrow 23 to urge the keeper member 4 into its blocking position.

The keeper member has a grooved region 24 readily engaged by a finger of the user so that this keeper member can be manually drawn downwardly against the force of this first spring out of the blocking or retention position into the release position.

The keeper member 4 is also provided with a key-operated mechanism 6, not illustrated in detail and conventional in luggage locks and the like, for locking the keeper member 4 against sliding motion and thereby retaining the lock in its closed position until a key is inserted to unlock the mechanism. In FIGS. 3-6, the embodiment there shown has a keeper member 104 which is held in its blocking position by a combination lock mechanism 16 with number wheels 25 and is swingable on the housing 103. The remaining elements of this lock correspond to those of FIGS. 1-2B. In the embodiment of FIGS. 3-6, however, the first spring means tends to swing the keeper member 104 in the direction of the arrow 26 seen in FIG. 4. As is best seen from FIGS. 5 and 6, the free end of the post 9 has a bevel or incline 12 which converges with a bevel or incline 13 formed at the end of the keeper member 4, 104 turned toward the post 9. From the position shown in FIG. 1 or in FIG. 5, should it be desirable to lock the gripper flaps 2, these can be placed in succession over the post 9, assuming the lock mechanism 6 or 16 is open. Simply by pressing the gripper flap over the post 9, the keeper member 4, 104 is cammed away from the post 9 to permit each gripper flap to be engaged below the keeper member. Release of a previously positioned gripper flap is prevented because it is engaged by the keeper member until the second gripper flaps is forced past the keeper member over the post 9. The lock mechanism can then be closed to block any removal of the gripper flaps from the post 9 and opening of the slide fastener. In the embodiment of FIGS. 1 and 2, the gripper flaps 2 are placed in the recesses 14.

To unlock the slide fastener, it is merely necessary to release the key-operated mechanism or the combination lock mechanism and to pull back or down the keeper member until it clears the upper most gripper flap 2, whereupon the force of the spring 7 will eject the gripper flaps.

I claim:

1. A lock for a receptacle having a slide fastener with a slider with a gripping flap provided with a hole, said lock comprising:

a housing;

a post fixed to said housing and projecting from said housing and positioned to project through said flap upon placing of said flap over said post;

a keeper member displaceable on said housing in a direction generally transverse to said post for engaging over said flap in a retention position to retain said flap on said post and for releasing said flap for withdrawal from said post upon temporary displacement into a release position, said keeper member being formed with an inclined surface at a portion of said keeper member proximal to said post for camming by said flap away from said post to permit fitting of said flap over said post, said portion of said keeper member engaging radially said post and being in contact therewith in said retention position; and a spring braced between said housing and said keeper member for continuously biasing said keeper member yieldably into said retention position and resisting camming by said flap away from said post, said keeper member being shaped to enable manual shifting of said keeper member against a force of said spring away from said post to release said flap.

2. A lock for a receptacle having a slide fastener with a slider with a gripping flap provided with a hole, said lock comprising:

a housing;

a post projecting from said housing and positioned to project through said flap upon placing of said flap over said post;

a keeper member displaceable on said housing in a direction generally transverse to said post for engaging over said flap in a retention position to retain said flap on said post and for releasing said flap for withdrawal from said post upon displacement into a release position, said keeper member being formed with an inclined surface at a portion of said keeper member proximal to said post for camming by said flap away from said post to permit fitting of said flap over said post;

a spring braced between said housing and said keeper member for biasing said keeper member yieldably into said retention position and resisting camming by said flap away from said post, said keeper member being shaped to enable manual shifting of said keeper member against a force of said spring away from said post to release said flap; and another spring at said post bearing against said flap and urging said flap off said post upon movement of said keeper member into said release position.

3. The lock defined in claim 2 wherein said other spring is a coil spring surrounding said post and seated against said housing, said coil spring having a free end formed with a split washer adapted to engage said flap.

4. The lock defined in claim 3 wherein said split washer has a circumferentially extending opening facilitating fitting of said washer around said post.

5. The lock defined in claim 2 wherein said post has a free end provided with an abutment edge limiting displacement of said other spring and maintaining said other spring under precompression.

6. The lock defined in claim 1 wherein said post has a free end formed with an inclined surface guiding said flap between said post and said keeper member.

7. The lock defined in claim 1 wherein said spring is at least one shank formed on said keeper member and engaged on said housing.

8. The lock defined in claim 1, further comprising a key-operated mechanism for immobilizing said keeper member on said housing in said retention position.

9. The lock defined in claim 1, further comprising a combination-lock mechanism for immobilizing said keeper member on said housing in said retention position.

10. The lock defined in claim 1, further comprising a recess formed on said housing and shaped to receive said flap when said flap is retained by said keeper member on said post.

11. A closure assembly for a receptacle, said closure assembly comprising:

at least one slide fastener closing an opening of said receptacle and having two slide-fastener sliders each formed with a respective flap having a generally circular hole therein; and a lock for said receptacle positioned between said sliders and comprising:

a housing, a post fixed to and projecting from said housing and positioned to project through said flaps upon placing of said flaps from opposite sides over said post, a keeper member displaceable on said housing in a direction generally transverse to said post for engaging over said flaps in a retention position to retain said flaps on said post and for releasing said flaps for withdrawal from said post upon displacement into a release position, said keeper member being formed with an inclined surface at a portion of said keeper member proximal to said post for camming by said flaps away from said post to permit fitting of said flaps over said post, and a spring braced between said housing and said keeper member for biasing said keeper member yieldably into said retention position and resisting camming by said flaps away from said post, said spring urging said keeper member to engage radially said post in said retention position of said keeper member by said portion thereof, said keeper member being shaped to enable manual shifting of said keeper member against a force of said spring away from said post to release said flaps.

12. A closure assembly for a receptacle, said closure assembly comprising:

at least one slide fastener closing an opening of said receptacle and having two slide-fastener sliders each formed with a respective flap having a generally circular hole therein; and a lock for said receptacle positioned between said sliders and comprising:

a housing, a post projecting from said housing and positioned to project through said flaps upon placing of said flaps from opposite sides over said post, a keeper member displaceable on said housing in a direction generally transverse to said post for engaging over said flaps in a retention position to retain said flaps on said post and for releasing said flaps for withdrawal from said post upon displacement into a release position, said keeper member being formed with an inclined surface at a portion of said keeper member proximal to said post for camming by said flaps away from said post to permit fitting of said flaps over said post, a spring braced between said housing and said keeper member for biasing said keeper member yieldably into said retention position and resisting camming by said flaps away from said post, said keeper member being shaped to enable manual shifting of said keeper member against a force of said spring away from said post to release said flaps, and another spring at said post bearing against said flaps and urging said flaps off said post upon movement of said keeper member into said release position.

13. The assembly defined in claim 12 wherein said other spring is a coil spring surrounding said post and seated against said housing, said coil spring having a free end formed with a split washer adapted to engage said flaps.

14. The assembly defined in claim 13 wherein said split washer has a circumferentially extending opening facilitating fitting of said washer around said post.

15. The assembly defined in claim 14 wherein said post has a free end provided with an abutment edge limiting displacement of said other spring and maintaining said other spring under precompression.

16. The assembly defined in claim 15 wherein said post has a free end formed with an inclined surface guiding said flap between said post and said keeper member.

17. The assembly defined in claim 15 wherein the first-mentioned spring is at least one shank formed on said keeper member and engaged on said housing.

18. The assembly defined in claim 15, further comprising a key-operated mechanism for immobilizing said keeper member on said housing in said retention position.

19. The assembly defined in claim 15, further comprising a combination-lock mechanism for immobilizing said keeper member on said housing in said retention position.

20. The assembly defined in claim 15, further comprising symmetrical recesses formed on said housing and shaped to receive said flaps when said flaps are retained by said keeper member on said post.

* * * * *